United States Patent [19]

Yamamoto et al.

[11] 4,361,925

[45] Dec. 7, 1982

[54] MAT-BASE ASSEMBLY

[75] Inventors: Yosuke Yamamoto, Toyonaka; Kinichi Sasagawa, Takatsuki, both of Japan

[73] Assignee: Duskin Franchise Co., Ltd., Osaka, Japan

[21] Appl. No.: 226,884

[22] Filed: Jan. 21, 1981

[30] Foreign Application Priority Data

Aug. 27, 1980 [JP] Japan ..... 55-117041

[51] Int. Cl.[3] ..... A47L 23/22; B32B 3/06; A47L 23/26

[52] U.S. Cl. ..... 15/217; 428/82; 428/95; 428/100

[58] Field of Search ..... 428/100, 82, 95; 15/215, 216, 217

[56] References Cited

U.S. PATENT DOCUMENTS

| | | | |
|---|---|---|---|
| 3,817,015 | 6/1974 | Frangos | 428/100 |
| 4,012,544 | 3/1977 | Richards | 428/100 |
| 4,177,305 | 12/1979 | Feingold et al. | 428/100 |
| 4,239,829 | 12/1980 | Cohen | 428/100 |

*Primary Examiner*—William R. Dixon, Jr.

*Attorney, Agent, or Firm*—Sherman & Shalloway

[57] ABSTRACT

Mat-base assembly comprises a base including a sheet integrally formed of an elastomeric polymer, a picture frame-like projection formed on the periphery of the sheet and a mat-containing portion formed on the inner side of the peripheral projection, a dust-controlling mat contained in the mat-containing portion and a temporary anchoring mechanism for anchoring detachably the base and mat at a plurality of points on the peripheral edge of the sheet, wherein an anchoring element comprising engaging pieces implanted on a base fabric is fixed to the base, a fiber loop element engageable with the engaging pieces is sewn to the mat and the peripheral portion of the anchoring element is fusion-bonded to the base sheet while in the remaining portion of the anchoring element, the engaging pieces are left as they are.

In this mat-base assembly, the durability of the anchoring mechanism is highly improved and good adaptability to the operation of attaching and detaching the dust-controlling mat is maintained for a long time. Furthermore, movement of the dust-controlling mat or roll-up of the corner portion of the mat can effectively be prevented.

7 Claims, 3 Drawing Figures

MAT-BASE ASSEMBLY

BACKGROUND OF THE INVENTION (1) Field of the Invention:

The present invention relates to a mat-base assembly. More particularly, the invention relates to a mat-base assembly in which the operation of attaching and detaching a dust-controlling mat is remarkably facilitated and this property is durable for a long time.

(2) Description of the Prior Art:

As means for preventing dusts adhering to shoe soles from intruding into rooms, a dust-controlling mat is widely used. This dust-controlling mat is placed and held at a predetermined position such as the entrance, and it must have such a property that even if it is violently rubbed with a sole of a shoe or if many persons come in and out while walking thereon, it is not easily moved. Furthermore, the end or corner portion of the mat should not easily be peeled off or rolled up.

As means satisfying these requirements, an assembly of such dust-controlling mat and a mat-supporting base is preferably used. As such assembly, Japanese Utility Model Publication No. 1606/74 proposes an assembly comprising a sheet of a thermoplastic resin such as a vinyl chloride resin having an oblong, oval or other optional form and a matting detachably fitted inside a picture-frame-like engaging projection formed on the periphery of the sheet.

However, if the mat is fitted only in such engaging projection formed on the periphery of the base, the object of preventing the mat from moving or preventing the corner portion of the mat from getting turned up is not satisfactorily attained. In case of a dust-controlling mat, there is adopted a system in which a mat is leased to a user for a certain time, the used mat is washed and regenerated by an oil impregnation treatment or the like and the regenerated mat is leased to a user again. As this cycle of using-regeneration is repeated, the mat shrinks and it becomes difficult to make the peripheral size of the mat in agreement with the size of the engaging projection of the base. In view of the foregoing, it is preferred that a temporary anchoring mechanism be disposed between the mat and the supporting base.

As such temporary anchoring mechanism, there has heretofore been used a so-called magic tape, that is, a combination of an anchoring element including engaging pieces implanted on a base fabric and a fiber loop element. Satisfactory results can be obtained by such magic tape when soft materials such as fiber fabrics are fitted together, but if this magic tape is applied to the above-mentioned mat-base assembly, this anchoring mechanism has no satisfactory durability and the adaptability to the operation of attaching and detaching the mat is degraded within a short period.

SUMMARY OF THE INVENTION

We made researches with a view to developing a mat-base assembly in which the foregoing defects are overcome, and we have now completed the present invention.

More specifically, in accordance with the present invention, there is provided a mat-base assembly which comprises a base including a sheet integrally formed of an elastomeric polymer, a picture-frame-like projection formed on the periphery of the sheet and a mat-containing portion formed on the inner side of said peripheral projection, a dust-controlling mat contained in said mat-containing portion and a temporary anchoring mechanism for anchoring detachably said base and mat at a plurality of points on the peripheral edge of the sheet, wherein an anchoring element comprising engaging pieces implanted on a base fabric is fixed to said base, a fiber loop element engageable with said engaging pieces is sewn to said mat and the peripheral portion of the anchoring element is fusion-bonded to the base sheet while in the remaining portion of the anchoring element, the engaging pieces are left as they are.

DETAILED DESCRIPTION OF THE PREFERRED EMBODIMENTS

The present invention will now be described in detail.

Figure 1:
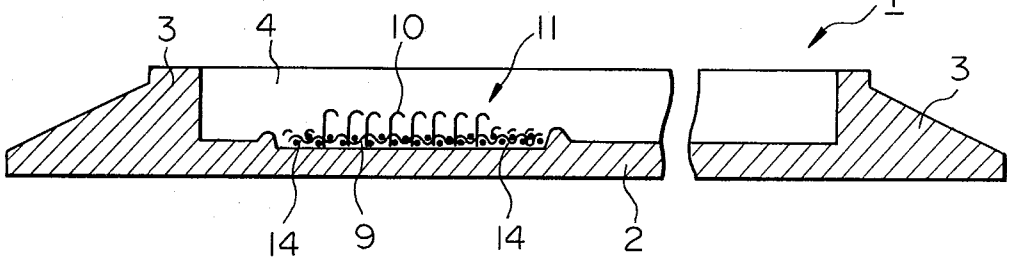
FIG. 1 is a sectional view showing a mat-supporting base.

Referring to FIG. 1 showing a mat-supporting base that is used in the present invention, this base 1 comprises an oblong or oval sheet 2 and a picture frame-like projection 3 formed on the periphery of the sheet 2. These sheet 2 and projection 3 are integrally formed of an elastomeric polymer, and a concave vacant portion 4 for receiving the dust-controlling mat is formed on the inner side of the projection 3.

As the elastomeric polymer, there can be mentioned, for example, a soft vinyl chloride resin composition, chlorinated polyethylene, chlorinated polypropylene, an ethylene-propylene rubber, an ethylene-propylene-diene rubber, polyisobutylene, a butyl rubber, polybutadiene, a styrene-butadiene rubber, a nitrile-butadiene rubber and polyurethane. The sheet formed of an elastomeric polymer should have a heat sealability. From this viewpoint, it is preferred that a soft vinyl chloride resin be used as the elastomeric polymer.

Figure 2:
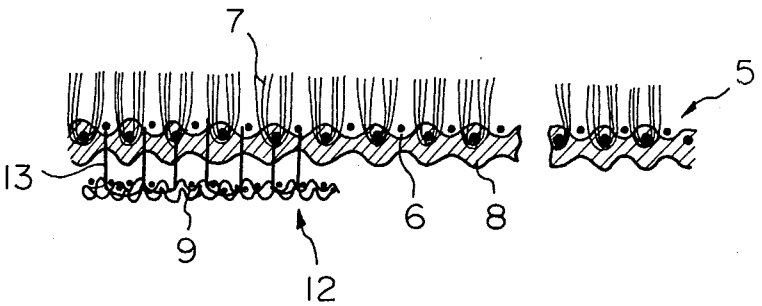
FIG. 2 is a sectional view showing a dust-controlling mat.

Referring to FIG. 2 showing a dust-controlling mat in the mat-base assembly of the present invention, this mat 5 comprises a base fabric 6, pile yarns 7 formed by tufting fibers to the base fabric 6 and trimming the top ends of the pile yarns 7 and a packing layer 8 for fixing the pile yarns 7 to the base fabric 6. The pile yarns 7 may be spun yarns or multi-filament yarns composed of at least one member selected from cotton fibers, rayon fibers, polyvinyl alcohol fibers, acrylic fibers and nylon fibers. The base fabric 6 may be a knitted or woven fabric, non-woven fabric or netting composed of fibers such as mentioned above or a plastic net or the like. The packing layer 8 is formed by coating a synthetic rubber latex such as a nitrile-butadiene rubber latex on the back side of the tufted base fabric and drying the coated latex.

The pile yarns 7 of the dust-controlling mat exert a function of adsorbing dusts adhering to shoe soles by sliding contact with the shoe soles and holding these dusts on the pile yarns 7. In order to enhance the dust adsorbing and holding action of the pile yarns 7, a dust adsorbing liquid may be coated on the pile yarns 7 or the pile yarns 7 may be impregnated with such liquid. As the dust adsorbing liquid, there can be mentioned, for example, mineral oils, synthetic oils and vegetable oils such as fluid paraffin, spindle oil, alkylbenzene oil, diester oil and castor oil, and aqueous dust adsorbing agents disclosed in Japanese Patent Publications Nos. 10194/78 and 37471/78.

In the present invention, instead of the above-mentioned tufted mat, there may be used a mat formed by electrostatically implanting fiber flocs on a base fabric.

According to the present invention, a temporary anchoring mechanism is disposed to detachably anchoring the base 1 and mat 5 to each other at a plurality of points on the peripheral edge of the mat 5.

Figure 3:
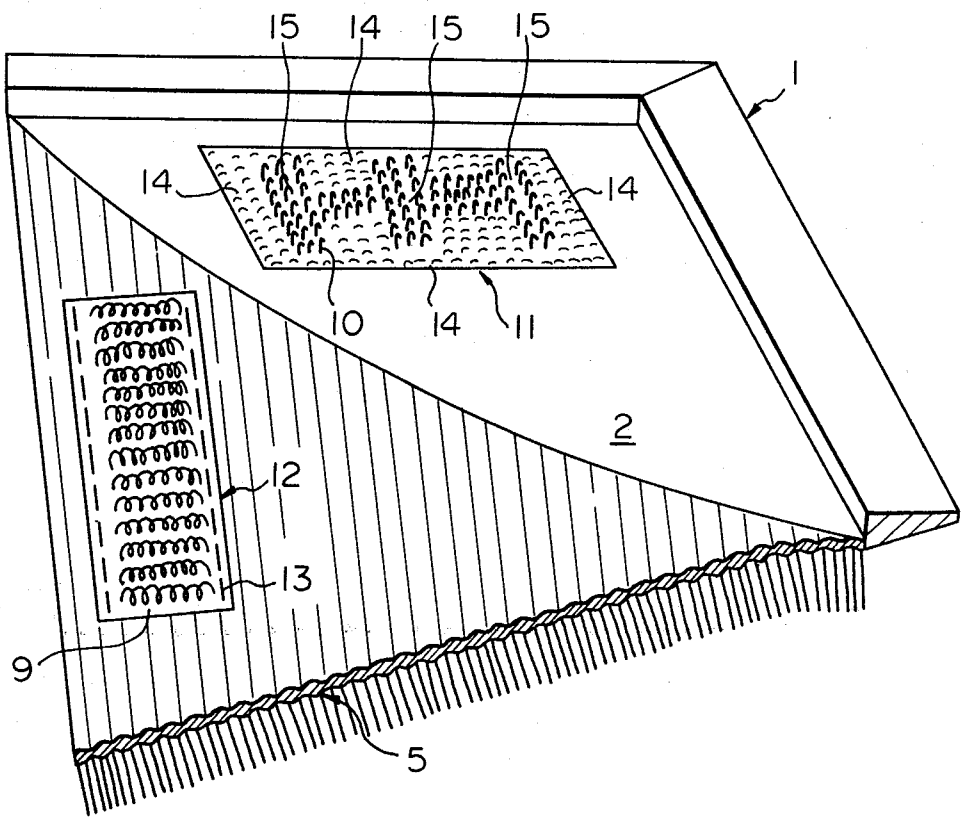
FIG. 3 is a partial perspective view showing a mat-base assembly in the state where one end of a mat is peeled.

As shown in FIGS. 1 and 3, this temporary anchoring mechanism comprises an anchoring element 11 includng hook-like or mushroom-like engaging pieces 10 implanted on a base fabric 9 and a fiber loop element 12 engageable with the engaging pieces 10. The combination of the anchoring element 11 and fiber loop element 12 is known as "magic tape", and is marketed under the tradename of, for example, "Velcro Fastener". The engaging pieces 10 of the anchoring element 11 are formed of nylon or polypropylene and they are implanted on a base fabric of nylon fibers or other thermoplastic fibers while the opposite side of the base fabric is coated with a resin such as polyurethane so as to prevent fall-out of the engaging pieces. The fiber loop element 12 is formed by implanting fibrous yarns in loopy configurations on a similar base fabric.

In the present invention, this loop element 12 is fixed to the back face of the mat 5 through stitches 13, and the anchoring element 11 is fixed to the sheet portion 2 of the base 1.

At this step, as shown in FIG. 1, the peripheral portion 14 of the anchoring element 11 is fusion-bonded to the base sheet 2, while the engaging pieces 11 are left in the remaining central portion of the engaging element 11 as they are.

According to the present invention, by fusion-bonding the peripheral portion of the anchoring element 11 to the base sheet 2, a very high bonding strength (peel strength) can be attained, and there can be formed a bonded structure which can sufficiently resist long-period repetition of attaching and detaching, outdoor exposure and dipping in water or hot water.

In the peripheral portion 14 of the anchoring element 11, since the anchoring element is fusion-bonded to the base sheet 2, the engaging pieces 10 are crushed or stuffed toward the base sheet. However, in the remaining portion 15 of the anchoring element 11, the engaging pieces 10 are left as they are and a necessary anchoring effect can be attained between these anchoring pieces 10 and the fiber loop element 11.

Indeed, one reason why a bonded structure excellent in the resistance characteristics is formed between the mat base 1 and the anchoring element 11 is that the polymer constituting the base sheet is fusion bonded to the base fabric or engaging pieces of the anchoring element 11 or the packing. However, it is believed that another important reason is that the elastomeric polymer constituting the base sheet is intruded into the base fabric of the anchoring element 11 and the engaging pieces 10 of the anchoring element 11 are intruded into the base sheet 2 through the base fabric of the anchoring element 11, and the mechanical engaging or anchoring effect is enhanced between the base sheet 2 and the anchoring element 11.

Fusion bonding of the anchoring element 11 to the mat base 1 can easily be accomplished by piling the anchoring element and base and pressing the piled assembly under heat by a pair of heat seal bars. The heating temperature may be in the range of the softening point of the polymer constituting the base sheet 2 to the melting or softening point of the base fabric of the anchoring element. A pressure sufficient to crush or stuff the engaging pieces 10 of the anchoring element 11, for example, 0.1 to 20 Kg/cm$^2$ (gauge), may be applied. Heating is advantageously performed by high frequency heating means.

When a polyurethane adhesive is interposed between the anchoring element and the base to be fusion-bonded, the adhesion strength on the interface can further be increased. If the packing of the anchoring element is composed of a polyurethane resin, increase of the adhesion strength is brought about by this polyurethane resin.

As the polyurethane resin, there is preferably used a polyurethane resin having terminal groups blocked by an alcohol, phenol or amine, that is, a heat-sensitive adhesive polyurethane resin.

In the preferred embodiment of the present invention, the blocked isocyanate and a polyol such as polyether polyol and polyester polyol is mixed at a stoichiometric ratio, the mixture wherein each of components is preferably solid and the mixture is also preferably solid at a room temperature is applied in solution or in molten state at a temperature not higher than 95° C. to the back surface of the anchoring element, the anchoring element is positioned at a predetermined position on the base sheet such that the applied surface contacts with the surface of the base sheet, and the combination of the anchoring element and the base sheet is heated at a temperature of 170° to 190° C. under a pressure of 0.1 to 20 Kg/cm$^2$ (gauge) by means of high frequency heating, whereby the dissociation of the blocked isocyanate to a free isocyanate and then the reaction between the reactivated isocyanate group with the coexisted polyol is caused to form a polyurethane resin in situ and increase of adhesion strength is attained.

For example, Collonate ® AP (Nippon Polyurethane Industries Co.), which is obtained by a reaction of tolylene diisocyanate and trimethylolpropane and followed by the addition of phenol to block the remaining isocyanate groups, is mixed with Placcel ® 220 (Daicel Chem. Industries Co.), which consists of polyesterpolyol formed by ring-opening polymerisation of caprolactone, at a mixing ratio by weight of 1:2, and this mixture is mixed with 0.33% by weight of cobalt octenoate, and then melted at about 95° C. This melted composition is applied on the back face of the anchoring element with the coating thickness of 0.1 to 0.8 mm. This applied anchoring element is laid on the predetermined position of the base that the applied surface contacts with the base and heated by high frequency heating means for 5 seconds at about 185° C. under a pressure of 2 Kg/cm$^2$. By this procedure, the anchoring element is bonded completely with the base surface and cannot be peeled off by 20 Kg/cm$^2$ of peeling.

The application of blocked isocyanate and polyol on the back of the anchoring element can be attained in solution of tetrahydrofuran or methylethylketone, and after the application the solvent can be evaporated.

As the other blocked isocyanates, we can use 4,4'-diisocyanate-diphenylmethane blocked by xylenols or methylethylketone-oxime and trimethylolpropane-tolylene-diisocyanate-adduct blocked by 2,4-dichlorophenol.

As the other polycol, we can use Desmophen 650 (Bayer GmbH) and Nippolan 4009 or 4010 (Nippon Polyurethane Industries Co.) as the polyester polyol, and also can use Pluronic Polyol (Wyandotte Chem. Corp.) as the polyether polyol. The polyol must be solid under the room temperature in order to be reserved safely through all seasons.

In the mat-base assembly of the present invention, the peripheral portion of the anchoring element, which is important from the viewpoint of the mechanical strength or prevention of rolling-up, is fusion-bonded to the base sheet in the state embedded therein, while the engaging pieces of the cental portion of the anchoring element are left as they are. Accordingly, the mat-base assembly of the present invention is advantageous in that the anchoring action is stably maintained over a long period even if the operation of attaching and detaching is repeated many times.

What we claim is:

1. A mat-base assembly which comprises a base comprising a sheet, a picture-frame-like projection formed on the periphery of the sheet and a mat-containing portion formed on the inner side of said peripheral projection, said sheet, peripheral projection and mat-containing portion being integrally formed from an elastomeric polymer, a dust-controlling mat contained in said mat-containing portion and a temporary anchoring mechanism for anchoring detachably said base and mat at a plurality of points on the peripheral edge of the sheet, wherein an anchoring element comprising engaging pieces implanted on a base fabric is fixed to said base, a fiber loop element engageable with said engaging pieces is sewn to said mat and the peripheral portion of the anchoring element is fusion-bonded to the base sheet at a temperature higher than the softening point of the polymer constituting the base sheet but lower than the melting or softening point of the base fabric of the anchoring element so that the engaging pieces in the peripheral portion are crushed or stuffed toward the base sheet while in the remaining central portion of the anchoring element, the engaging pieces are left as they are, whereby the mat can be securely but detachably anchored to the base when the mat is seated within said mat-containing portion with the engaging pieces of the anchoring element engaging the fiber loop element.

2. A mat-base assembly as set forth in claim 1, wherein fusion bonding is carried out through a polyurethane resin layer interposed between the base fabric of the anchoring element and the base sheet.

3. A mat-base assembly as set forth in claim 2 wherein the polyurethane resin is formed in situ by reaction of an isocyanate blocked by an alcohol, phenol or amine with a polyol selected from the group consisting of polyether polyols and polyester polyols.

4. A mat-base assembly for securely and detachably retaining a dust controlling mat in a mat-containing portion of said mat, said assembly comprising (A) a base member comprising (1) a base sheet having an upper surface, (2) a skirt member upwardly extending from and integrally connected to the outer peripheral edge of the upper surface of said base sheet, and defining, with said upper surface, a mat-containing portion, said base sheet and said skirt member being formed of an elastomeric polymer, and (3) at least one anchoring element, each comprising a base fabric and engaging pieces fixedly attached to said base fabric, each said anchoring element being fusion-bonded to said upper surface of said base sheet over a portion of the total area of each said anchoring element at a temperature higher than the softening point of the elastomeric polymer but lower than the melting or softening point of the base fabric whereby the engaging elements in said fusion-bonded portion are crushed or stuffed toward the base sheet while the remaining engaging pieces in the non-fusion-bonded portion of each said anchoring element are left intact;

(B) a dust controlling mat of a size fitting within said mat-containing portion; and (C) at least one fiber loop element fixed to the dust controlling mat and detachably engageable with the remaining engaging pieces of said at least one anchoring element to securely but detachably anchor said mat to said base member when said mat is seated within said mat-containing portion with said at least one fiber loop element facing and engaging said at least one anchoring element.

5. The mat-base assembly of claim 4 wherein a plurality of said anchoring elements are fusion-bonded to said upper surface at spaced apart zones along the peripheral edge of said mat-containing portion and a corresponding plurality of fiber loop elements are fixedly attached to said dust controlling mat, whereby a plurality of fiber loop elements will contact a plurality of the anchoring elements to securely but detachably hold the dust controlling mat to the base member when the mat and base member are in assembled engagement with the mat seated in said mat-containing portion.

6. The mat-base assembly of claim 4 which further comprises a polyurethane resin layer interposed between the base fabric of the anchoring element and the upper surface of the base sheet.

7. The mat-base assembly of claim 1 or claim 4 wherein the fusion-bonding causes the elastomeric polymer of the base sheet to penetrate into the base fabric of the anchoring element to thereby enhance the mechanical engagement between the base sheet and the anchoring element.

* * * * *